US006868979B2

(12) United States Patent
Rader

(10) Patent No.: US 6,868,979 B2
(45) Date of Patent: Mar. 22, 2005

(54) COLLAPSIBLE PLASTIC CONTAINER WITH LOCKING FEATURE

(75) Inventor: Henning Rader, Middleburg, VA (US)

(73) Assignee: Monoflo International, Inc., Winchester, VA (US)

( * ) Notice: Subject to any disclaimer, the term of this patent is extended or adjusted under 35 U.S.C. 154(b) by 85 days.

(21) Appl. No.: 10/431,370

(22) Filed: May 8, 2003

(65) Prior Publication Data

US 2004/0222221 A1 Nov. 11, 2004

(51) Int. Cl.[7] ..... B65D 6/16
(52) U.S. Cl. ..... 220/7; 220/6; 220/4.28
(58) Field of Search ..... 220/6, 7, 4.28, 220/4.33, 4.34, 616, 626, 642, 646, 650, 666, 729; 206/509

(56) References Cited

U.S. PATENT DOCUMENTS

| | | | | | |
|---|---|---|---|---|---|
| 1,488,418 | A | * | 3/1924 | Walther | 220/7 |
| 3,796,342 | A | * | 3/1974 | Sanders et al. | 220/6 |
| 4,798,304 | A | * | 1/1989 | Rader | 220/6 |
| 4,863,056 | A | * | 9/1989 | Inayama | 220/6 |
| 4,913,302 | A | * | 4/1990 | Stonier | 220/6 |
| 5,038,953 | A | | 8/1991 | Radar | |
| 5,064,068 | A | * | 11/1991 | Sheng | 206/425 |
| 5,353,948 | A | | 10/1994 | Lanoue et al. | |
| 5,429,261 | A | * | 7/1995 | Machino | 220/7 |
| 5,881,880 | A | | 3/1999 | Jacques et al. | |
| D417,539 | S | | 12/1999 | Koskinen | |
| 6,029,840 | A | | 2/2000 | Brauner | |
| D423,217 | S | | 4/2000 | Varfeldt | |
| D424,299 | S | | 5/2000 | Varfeldt | |
| 6,135,287 | A | | 10/2000 | Hartwall | |
| 6,230,916 | B1 | * | 5/2001 | Bradford et al. | 220/6 |
| 6,283,319 | B1 | | 9/2001 | Hillis et al. | |
| 6,293,417 | B1 | | 9/2001 | Varfeldt | |
| 6,398,054 | B1 | * | 6/2002 | Overholt et al. | 220/7 |
| 6,444,149 | B1 | | 9/2002 | Valentinsson | |
| 6,484,898 | B2 | | 11/2002 | Hillis et al. | |
| 6,601,724 | B1 | * | 8/2003 | Koefelda et al. | 220/6 |
| 6,616,003 | B1 | * | 9/2003 | Polenta | 220/7 |

FOREIGN PATENT DOCUMENTS

| | | | | |
|---|---|---|---|---|
| JP | 06024440 A | * | 2/1994 | B65D/06/18 |

* cited by examiner

*Primary Examiner*—Jes F. Pascua
*Assistant Examiner*—Harry A. Grosso
(74) *Attorney, Agent, or Firm*—Nixon & Vanderhye P.C.

(57) ABSTRACT

A collapsible plastic container includes a top perimeter, a bottom and a plurality of sidewalls formed in a generally rectangular configuration. At least one of the sidewalls is pivotable between a collapsed position and an opened position. An engaging portion of the pivotable sidewall includes a first opening therein, which is disposed adjacent a receiving portion of either the top perimeter and the bottom including a second opening therein in the opened position. The first and second openings are relatively positioned such that they are aligned when the pivotable sidewall is in its opened position. A locking lug is positioned such that it is extendible into the aligned openings of an adjacent container when the container and the adjacent container are in a stacked arrangement. A lid may also be provided including a second locking lug. The structure ensures that the sidewalls are securely held in their vertical position to thereby ensure that the container will bear its maximum load. Additionally, the locking lugs prevent the sides from being pushed in when the containers are stacked or closed to thereby provide added security.

10 Claims, 6 Drawing Sheets

COLLAPSIBLE PLASTIC CONTAINER WITH LOCKING FEATURE

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to plastic containers and, more particularly, to a collapsible plastic container including a locking feature cooperable with adjacent containers in a stacked arrangement.

Collapsible plastic containers are used in a variety of industrial and commercial applications. These containers offer the convenience of large holding capacity and, when collapsed, a minimum space requirement for storage. An exemplary collapsible plastic container is described in commonly-owned U.S. Pat. No. 5,038,953, the disclosure of which is incorporated by reference.

Existing collapsible containers typically operate in a similar manner. A top perimeter and bottom accept the attachment of sidewalls that are hinged to allow the entire assembly to be folded. Generally, the longer sides are constructed with two parts hinged in the middle and attached to both the top perimeter and bottom. The shorter sides or end walls are attached to the top perimeter or bottom and fold inward to collapse the container.

In most containers of this type, the side attached to a single component is secured in position only by a ramp or bump, past which its moving end passes as it swings into final position. This function may be accomplished in a similar fashion via cantilevered snaps. Other containers use an additional part to provide a sliding latch. It is important to positively retain these sides in their fully erect position to ensure that the container can bear the weight of containers that may be stacked on top of it.

With most latching schemes, however, the contents of stacked containers may be pilferable since access to the interior can be gained simply by pushing in the swinging side. It would be desirable to obviate this drawback without requiring the addition of an extra part or latch.

BRIEF SUMMARY OF THE INVENTION

The present invention proposes a collapsible container that overcomes the drawbacks noted above with respect to conventional collapsible containers. In the invention, sides of the containers in a stacked arrangement are positively secured by locking lugs that are preferably integral to each container. The locking lugs form a part of the top perimeter or container bottom so that the process of stacking the containers places the locking lug in a receptacle of the upper or lower container. The receptacle is formed via aligned openings in the pivoting side and either the top perimeter or bottom, depending upon the location of the pivoting side pivot axis.

In an exemplary embodiment of the invention, a collapsible plastic container includes a top perimeter, a bottom and a plurality of side walls. At least one of the plurality of side walls is pivotable between a collapsed position and an opened position. The pivotable side wall includes an engaging portion disposed adjacent a top receiving portion of the top perimeter in the opened position. The top receiving portion includes a first opening therein, and the engaging portion of the pivotable side wall includes a corresponding second opening therein. The first and second openings are relatively positioned such that they are aligned when the pivotable side wall is in the opened position. A locking lug protrudes from the bottom and is positioned such that the locking lug is extendible into aligned first and second openings of an adjacent container when the container is stacked on the adjacent container.

The locking lug may be formed integral with the bottom. In addition, preferably two of the plurality of side walls are pivotable between the collapsed position and the opened position. In one arrangement, the bottom includes a bottom surface that has a depth extending below the locking lug.

Additionally, the container may include a container lid sized to fit over the top perimeter. The container lid incorporates a second locking lug extendible into the aligned first and second openings of the container.

In another exemplary embodiment of the invention, the pivotable side wall of the collapsible plastic container includes an engaging portion disposed adjacent a receiving portion of one of the top perimeter or the bottom in the opened position. The receiving portion includes a first opening therein, and the engaging portion of the pivotable side wall includes a corresponding second opening therein, which are relatively positioned such that they are aligned when the pivotable side wall is in the opened position. The locking lug is positioned such that the locking lug is extendible into aligned first and second openings of an adjacent container when the container and the adjacent container are in a stacked arrangement.

In still another exemplary embodiment of the invention, a method of securing the collapsible plastic container of the invention includes the steps of forming a first opening in the receiving portion; forming a corresponding second opening in the engaging portion of the pivotable side wall, wherein the first and second openings are relatively positioned such that they are aligned when the pivotable side wall is in the opened position; and inserting a locking lug of an adjacent container into aligned first and second openings of the container when the container and the adjacent container are in a stacked arrangement.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
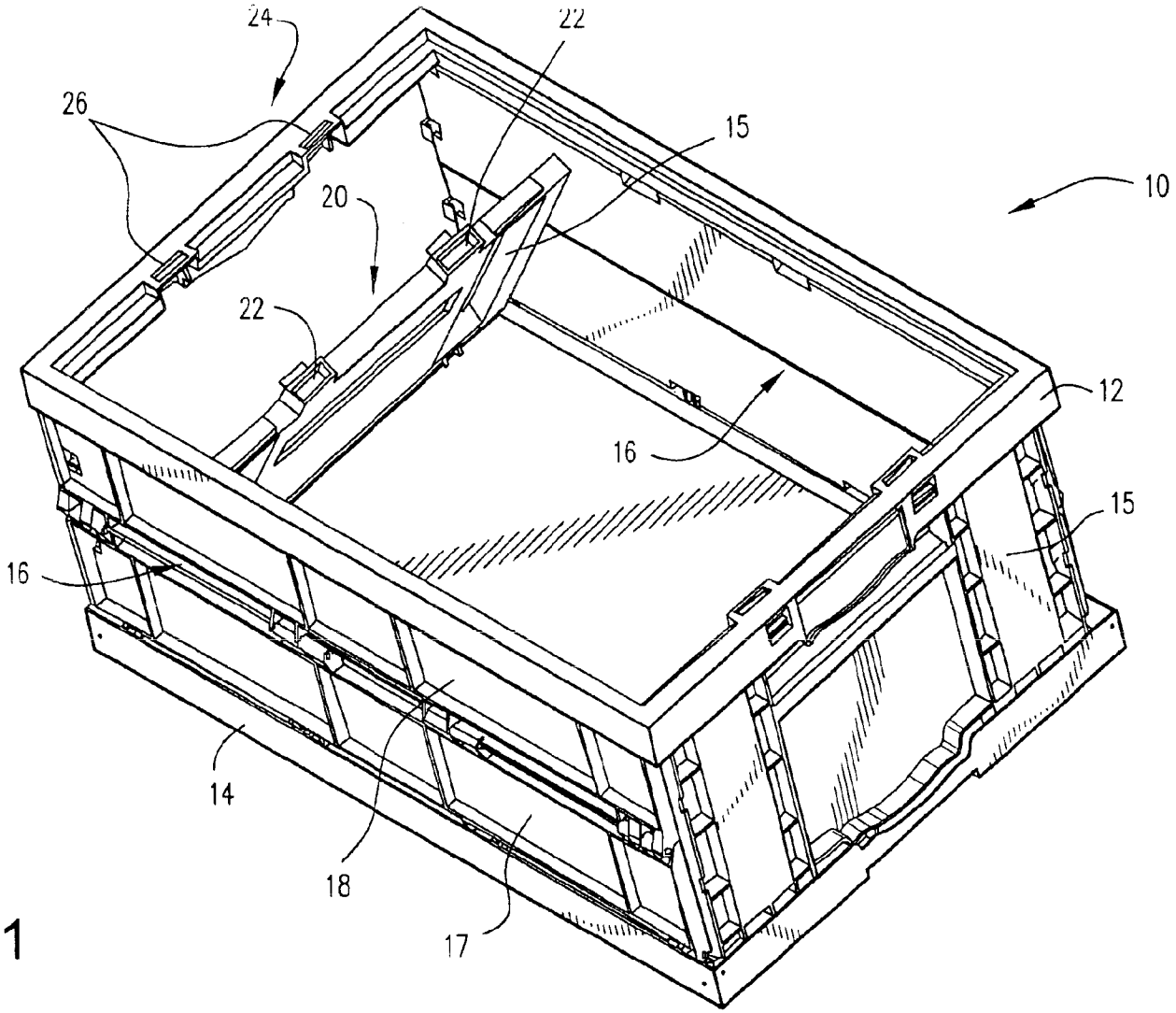
FIG. 1 is a perspective view of the collapsible container of the present invention showing a pivotable sidewall between its collapsed position and opened position.
Figure 2:
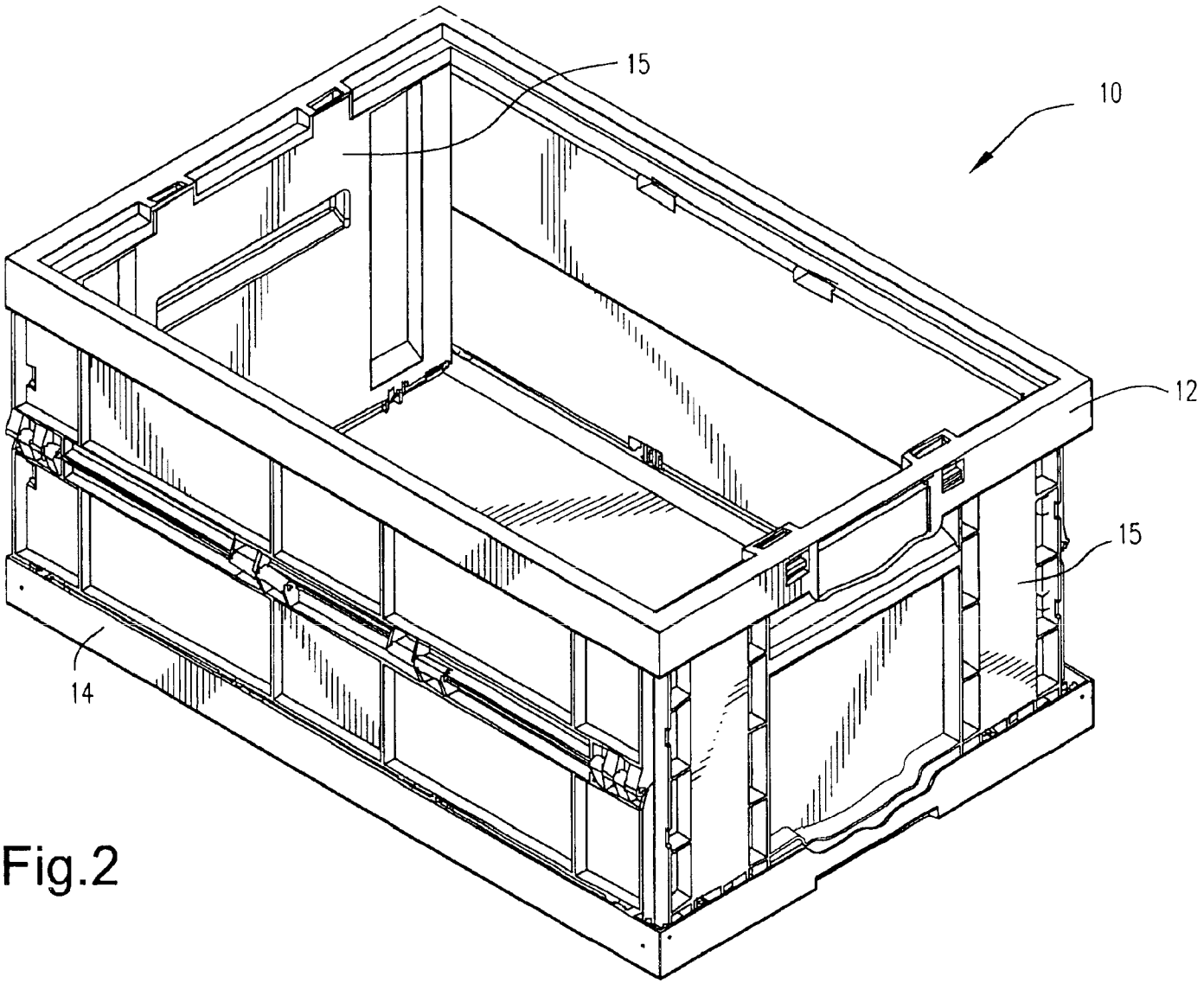
FIG. 2 is a perspective view of a fully open container.

The collapsible container 10 of the present invention is movable from a collapsed position to an open operative (erect) position as shown in FIGS. 1 and 2. The generally conventional elements of the container 10 include an open top form or top perimeter 12, a bottom panel 14, two ends or end panels 15 and two sides 16. Each of the sides is composed of first and second panels 17, 18 that are pivotably connected together at a center portion of the sides 16 as shown. The first panels 17 are pivotably connected to the bottom 14, and the second panels 18 are pivotably connected to the top perimeter 12 so that the first and second panels pivot with respect to each other and the top perimeter and bottom about parallel side axes.

With continued reference to FIGS. 1 and 2, the pivotable end walls 15 are preferably pivotably connected to the bottom 14 via a hinge or other suitable connection. The end wall 15 includes an engaging portion 20 including at least one, preferably two, through holes or openings 22. The top perimeter 12 includes a corresponding top receiving portion 24 also including through holes or openings 26 therein. As shown in FIG. 2, the openings 22 of the engaging portion 20 are relatively positioned such that they are aligned with the openings 26 in the top receiving portion 24 when the end wall 15 is fully pivoted to its opened position.

Figure 3:
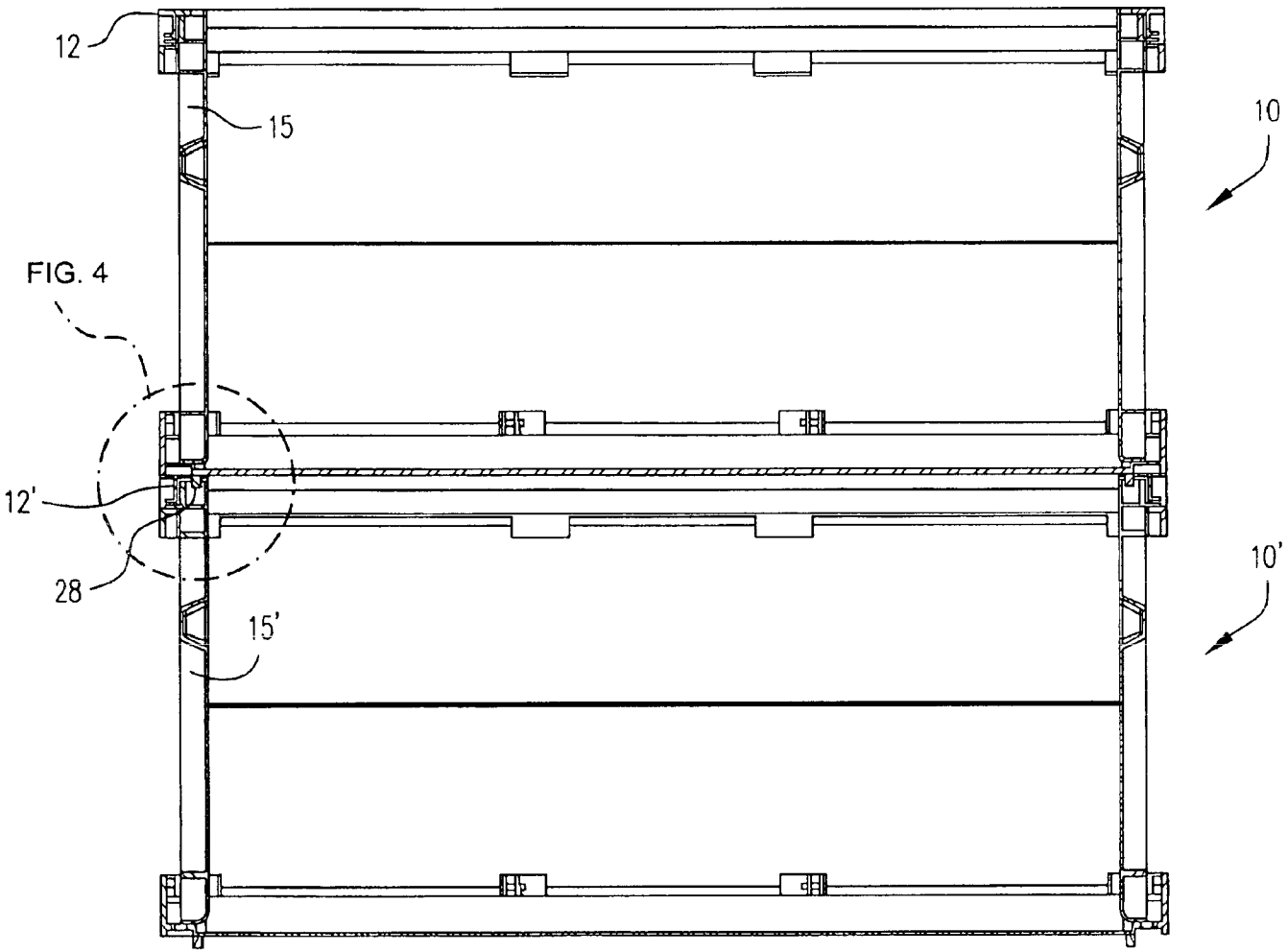
FIG. 3 is a side view showing two containers in a stacked arrangement.
Figure 4:
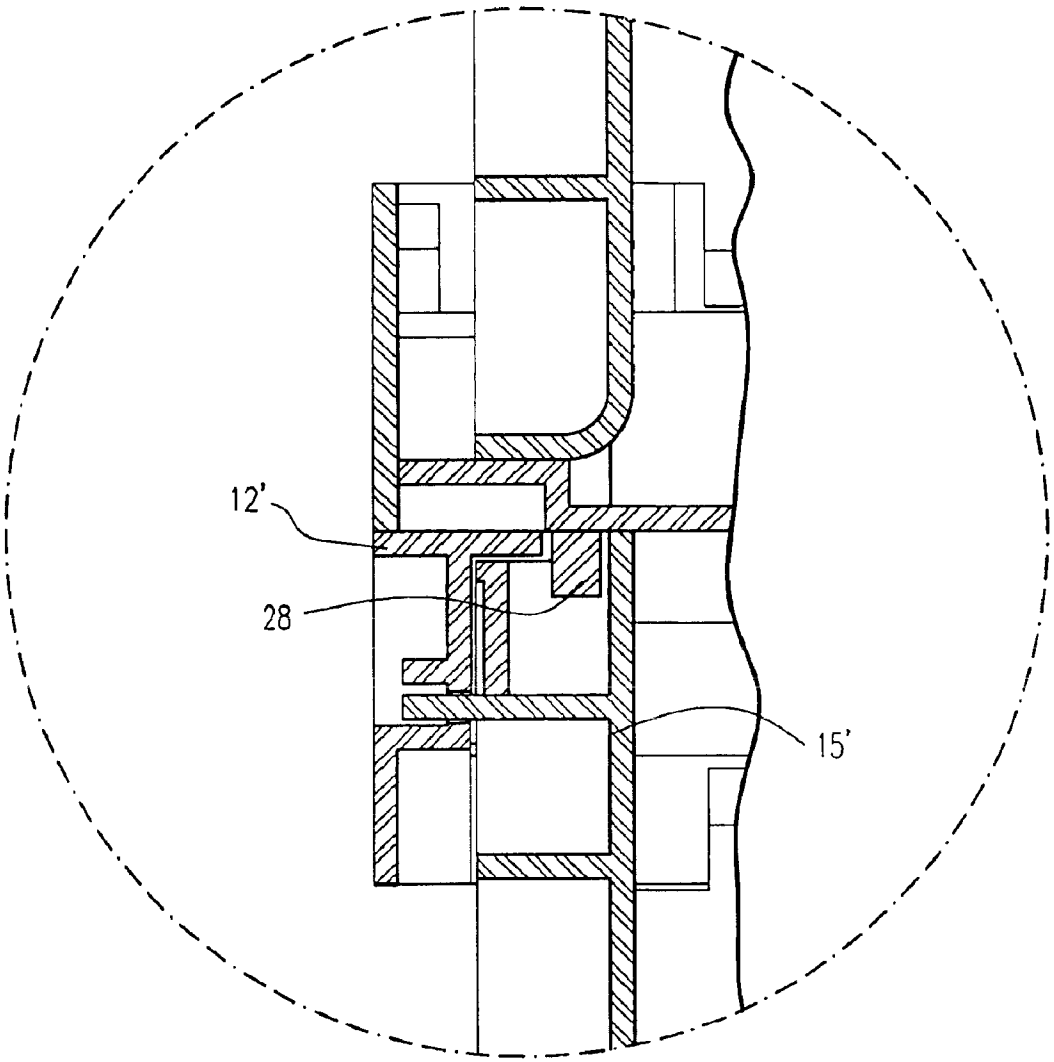
FIG. 4 is a close-up view showing the locking lug of one container engaging the aligned openings of an adjacent container.
Figure 5:
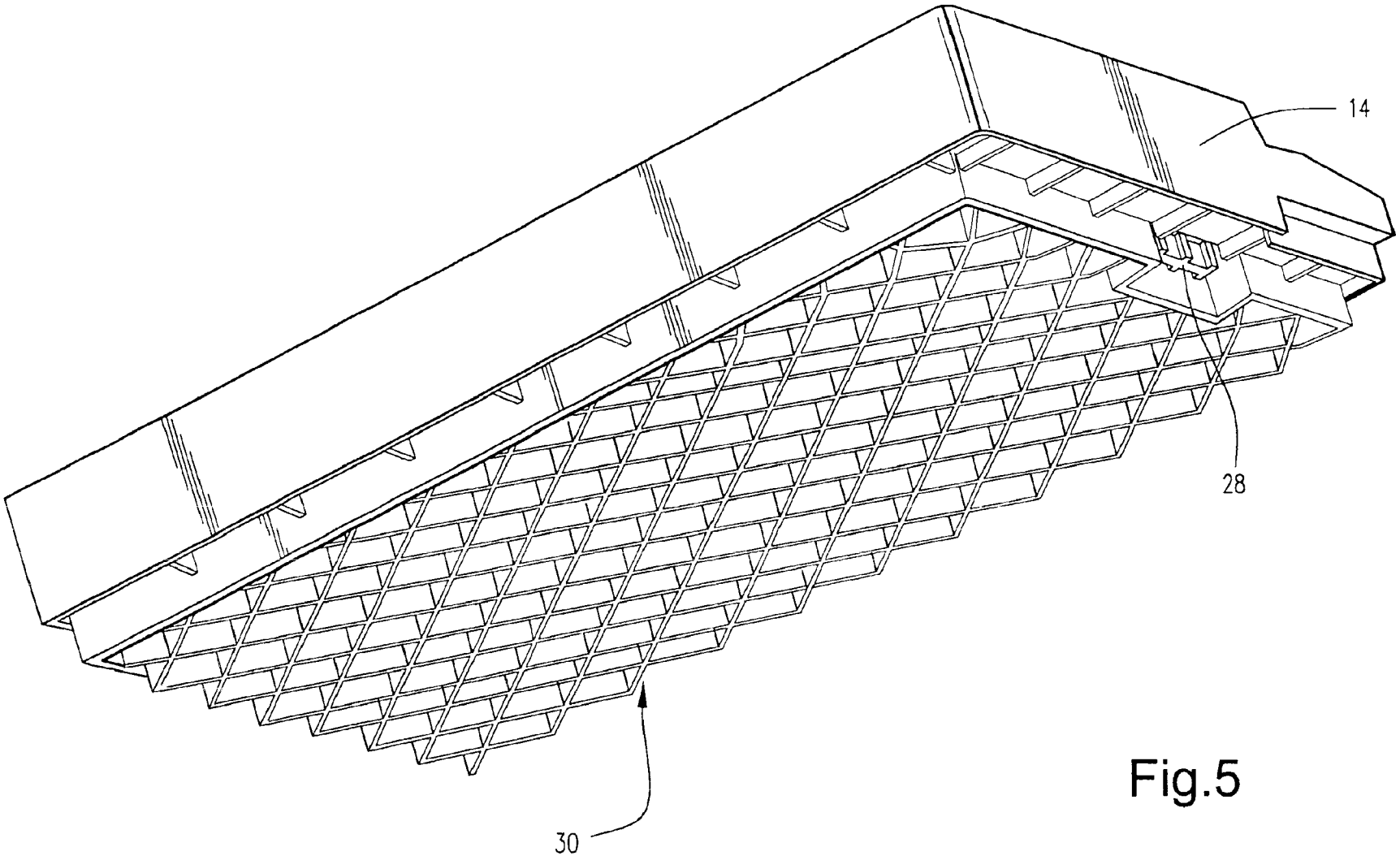
FIG. 5 is a perspective view of a bottom surface of the container.

With reference now to FIGS. 3–5, the container 10 of the invention also includes a locking lug 28 protruding from the container bottom 14. The locking lug 28 is positioned such that it extends into the aligned openings 22, 26 of an adjacent container 10' when the container 10 is stacked on the adjacent container 10'. Preferably, the locking lug 28 is formed integral with the bottom 14, and an additional manufacturing step such as incorporating a latch assembly or the like is unnecessary. As shown in FIG. 5, a bottom surface 30 of the bottom 14 preferably has a depth extending below the locking lugs 28 so that the container 10 is not supported by the locking lugs 28 when resting on the floor.

Figure 6:
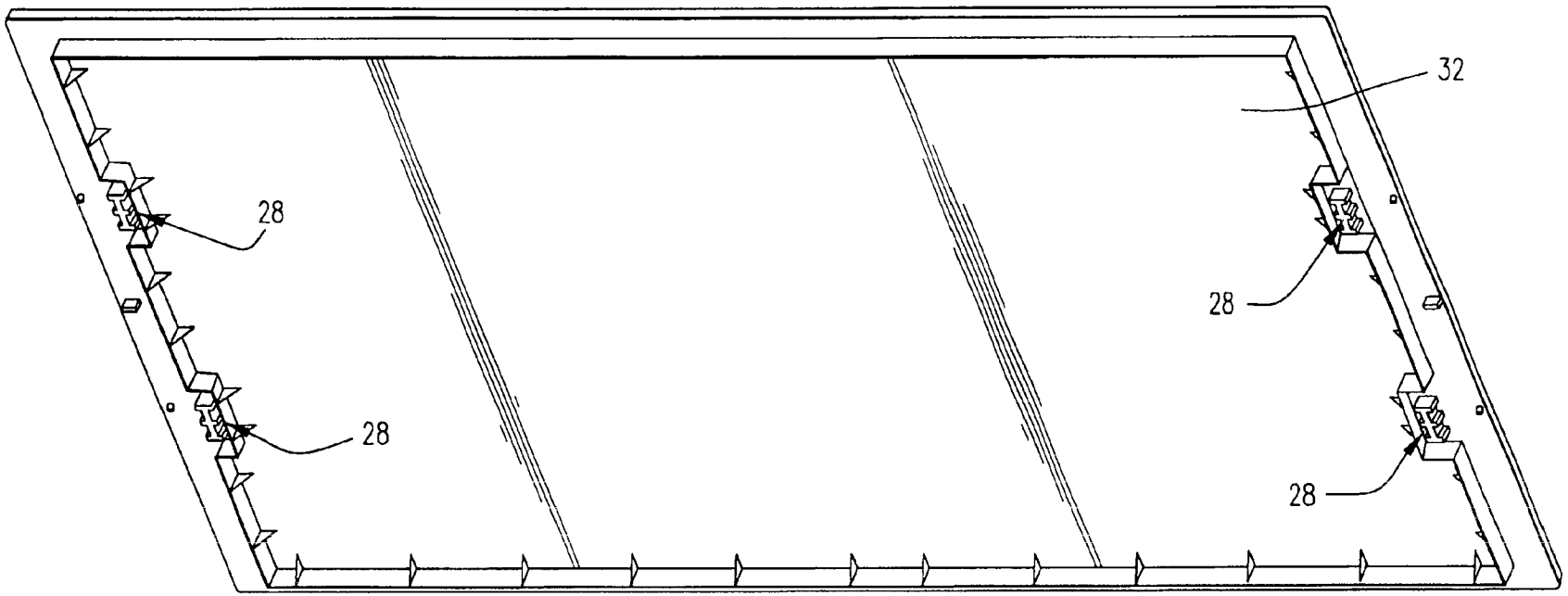
FIG. 6 is a perspective view of a container lid.

As shown in FIG. 6, a lid 32 for the container 10 is sized to fit over the top perimeter 12. Typically, except for the top container, containers are stacked without lids in order reduce container costs and minimize stacked height. Of course, lids for each container may be used if desired. Lids may also be placed on single containers to protect the contents from dust or other contaminants. In this context, the lid 32 of the present invention is provided with locking lugs 28 that are extendible into the aligned openings 22, 26 of the container 10. In this manner, the container 10 can be secured independent of adjacent containers 10'.

Although FIG. 1 shows the pivotable end wall 15 pivotably secured to the bottom 14, the end walls 15 may alternatively be pivotably connected to the top perimeter 12. In this context, the openings 22, 26 would be positioned in the bottom 14 and the locking lugs 28 would be disposed adjacent the top perimeter 12 or extend from a top surface of the lid 32. The invention is thus not necessarily meant to be limited to the illustrated configuration.

With the structure of the present invention, pivotable side or end walls can be securely held in their fully open vertical position, thereby ensuring that when stacked or closed, the container will bear a maximum weight. In addition, when containers are stacked with a cover or lid on the top container and banded or otherwise secured, the structure of the invention provides an additional level of security. When assembled as described, the sides cannot be pushed in to gain access to the contents of the containers as may be done on conventional containers. These advantages are achieved without the complexity of additional moving parts needed to create latching mechanisms and the like.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A collapsible plastic container comprising a top perimeter, a bottom and a plurality of side walls, at least one of the plurality of side walls being pivotable between a collapsed position and an opened position, the pivotable side wall having an engaging portion disposed adjacent a top receiving portion of the top perimeter in the opened position, wherein the top receiving portion includes a first opening therein, and wherein the engaging portion of the pivotable side wall includes a corresponding second opening therein, the first and second openings being relatively positioned such that they are aligned when the pivotable side wall is in the opened position, and wherein a locking lug protrudes from the bottom, the locking lug being positioned such that the locking lug is extendible into aligned first and second openings of an adjacent container when the container is stacked on the adjacent container.

2. A collapsible plastic container according to claim 1, wherein the locking lug is integral with the bottom.

3. A collapsible plastic container according to claim 1, wherein two of the plurality of side walls are pivotable between the collapsed position and the opened position.

4. A collapsible plastic container according to claim 1, wherein the bottom comprises a bottom surface having a depth extending below the locking lug.

5. A collapsible plastic container according to claim 1, further comprising a container lid sized to fit over the top perimeter, the container lid including a second locking lug extendible into the aligned first and second openings of the container.

6. A collapsible plastic container comprising:

a top perimeter;

a bottom;

a plurality of side walls, at least one of the plurality of side wails being pivotable between a collapsed position and an opened position, the pivotable side wall having an engaging portion disposed adjacent a receiving portion of one of the top perimeter and the bottom in the opened position, wherein the receiving portion includes a first opening therein, and wherein the engaging portion of the pivotable side wall includes a corresponding second opening therein, the first and second openings being relatively positioned such that they are aligned when the pivotable side wall is in the opened position; and a locking lug positioned such that the locking lug is extendible into aligned first and second openings of an adjacent container when the container and the adjacent container are in a stacked arrangement.

7. A collapsible plastic container according to claim 6, wherein the receiving portion is formed in the top perimeter, and wherein the locking lug is formed integral with the bottom.

8. A collapsible plastic container according to claim 7, wherein the bottom comprises a bottom surface having a depth extending below the locking lug.

9. A collapsible plastic container according to claim 7, further comprising a container lid sized to fit over the top perimeter, the container lid including a second locking lug extendible into the aligned first and second openings of the container.

10. A collapsible plastic container according to claim 6, wherein two of the plurality of side walls are pivotable between the collapsed position and the opened position.

* * * * *